United States Patent [19]

Reynolds et al.

[11] 4,258,973

[45] Mar. 31, 1981

[54] CONNECTING MEANS HAVING KINEMATIC CONDUCTOR-CONTACTING PORTIONS

[75] Inventors: Charles E. Reynolds, Mechanicsburg; Robert C. Swengel, Jr., York, both of Pa.

[73] Assignee: AMP Incorporated, Harrisburg, Pa.

[21] Appl. No.: 46,300

[22] Filed: Jun. 7, 1979

[51] Int. Cl.[3] ..... H01R 4/28

[52] U.S. Cl. ..... 339/95 R; 339/276 R

[58] Field of Search ..... 339/95 R, 97 C, 247, 339/254, 273, 98, 99, 176 MF, 276 R

[56] References Cited

U.S. PATENT DOCUMENTS

| | | | |
|---|---|---|---|
| 3,199,065 | 8/1965 | Thompson | 339/149 |
| 3,601,774 | 8/1971 | Stathos | 339/176 |
| 3,932,018 | 1/1976 | Parsons | 339/99 R |
| 3,979,615 | 9/1976 | Neff | 339/95 D X |
| 4,026,013 | 5/1977 | Hughes | 339/276 R |
| 4,166,265 | 8/1979 | Reynolds et al. | 339/273 R X |
| 4,183,607 | 1/1980 | Hughes | 339/97 R |

*Primary Examiner*—John McQuade
*Assistant Examiner*—John S. Brown
*Attorney, Agent, or Firm*—Frederick W. Raring

[57] ABSTRACT

Connecting means comprises an electrical terminal and a housing having a terminal-receiving cavity therein. The terminal is a flat one-piece sheet metal device having two integral four-bar linkage mechanisms thereon arranged symmetrically with respect to an axis extending medially through the terminal. The connecting or floating links of the linkages are adjacent to the axis, the fixed links are relatively remote from the axis, and the crank links extend diagonally between the fixed and connecting links. When a wire is positioned between the connecting links and the two four-bar linkages are deformed by applying deforming forces to the ends of the connecting links, the connecting links move laterally towards each other and clamp the wire between their opposed surfaces. The cavity in the housing has wire-admitting slots which permit placement of the wire with its axis extending transversely across the cavity and a shoulder is provided adjacent to the inner end of the cavity which is engageable with the ends of the connecting links when the terminal is inserted. The arrangement is such that upon placement of the wire in the cavity and insertion of the terminal, the four-bar linkages are deformed and contact is established with the wire.

10 Claims, 10 Drawing Figures

CONNECTING MEANS HAVING KINEMATIC CONDUCTOR-CONTACTING PORTIONS

FIELD OF THE INVENTION

This invention relates to electrical connecting means for establishing electrical contact with a conductor. The embodiment described below is particularly intended for forming electrical connections to relatively fine wires having a thin film of varnish-type insulation thereon, and the invention is accordingly described with reference to fine wire electrical connections. The principles of the invention can be used for a wide variety of electrical connections under conditions other than the conditions described below.

BACKGROUND OF THE INVENTION

Electrical connections to relatively fine wires in the range of about AWG-30 to AWG-50 have, until relatively recently, been made by winding a portion of the wire around a simple terminal post and then soldering the wire to the post. When the fine wire extends from a coil, the lead wires are similarly soldered to the post.

U.S. Pat. No. 4,026,013 discloses and claims a solderless electrical connection for fine wires comprising an insulating housing having a cavity therein which receives a trapezoidal terminal having obtuse and acute included angles. The electrical connection is established by positioning the wire against one wall of the housing cavity, inserting the terminal and then deforming the terminal in a manner such that it becomes rectangular and one of the sides of the terminal is resiliently pressed into engagement with the wire. The terminal inserting and terminal deforming operations are carried out by a specialized tool having two terminal engaging members, one of which serves to insert the terminal into the cavity and the other one of which deforms the terminal after it has been inserted.

Connecting devices of the type described in the above identified patent are being widely used. However, it is impractical or inconvenient to use this known connection means under many circumstances where connections to fine wires must be made. The terminal shown in U.S. Pat. No. 4,026,013 is of substantial width relative to the diameter of the wire and is impractical for use under many circumstances for this reason. For example, where electrical connections must be made to a winding wire on a small bobbin, the thickness of the terminal and the resulting required dimensions of the terminal housing which must be provided on the bobbin are such that the bobbin cannot be placed in many types of equipment where it is required. The requirement of compound tooling as described above for the terminal shown in U.S. Pat. No. 4,026,013 is also inconvenient under any circumstances where electrical connections must be made to fine wires.

The present invention is directed to the achievement of an improved connecting means for fine wires which requires only an extremely thin flat terminal and a correspondingly relatively thin terminal housing and further, which can be connected to the wire by simply inserting the terminal into the cavity in the housing.

In accordance with a preferred embodiment, the terminal comprises a flat sheet metal member having a leading and a trailing end and fixed spaced-apart fixed links extending between the ends. The fixed links of the terminal serve as the fixed links of two four-bar mechanisms each of which comprises, in addition to a fixed link, two spaced-apart crank links and a floating or connecting link. The connecting links of the two mechanisms extend substantially parallel to each other on each side of a central axis of symmetry and the crank links extend diagonally from the ends of the connecting links to the ends of the fixed links. The arrangement is such that upon positioning a conductor between the connecting links and then applying deforming forces to the ends of the connecting links, the four-bar mechanisms are deformed or deflected until the crank links extend substantially normally, rather than diagonally, of the fixed and connecting links. This deformation of the four-bar mechanisms causes the connecting links to move laterally towards each other so that the conductor is clamped between the opposed edge surfaces of the connected links, thereby to establish contact with the conductor. The housing which receives the terminal has a cavity dimensioned to receive the terminal and a shoulder in this cavity engages the ends of the connecting links during movement of the terminal into the cavity thereby to bring about deformation of the four-bar linkages and the establishment of electrical contact with the wire.

DESCRIPTION OF THE DRAWINGS

Figure 1:
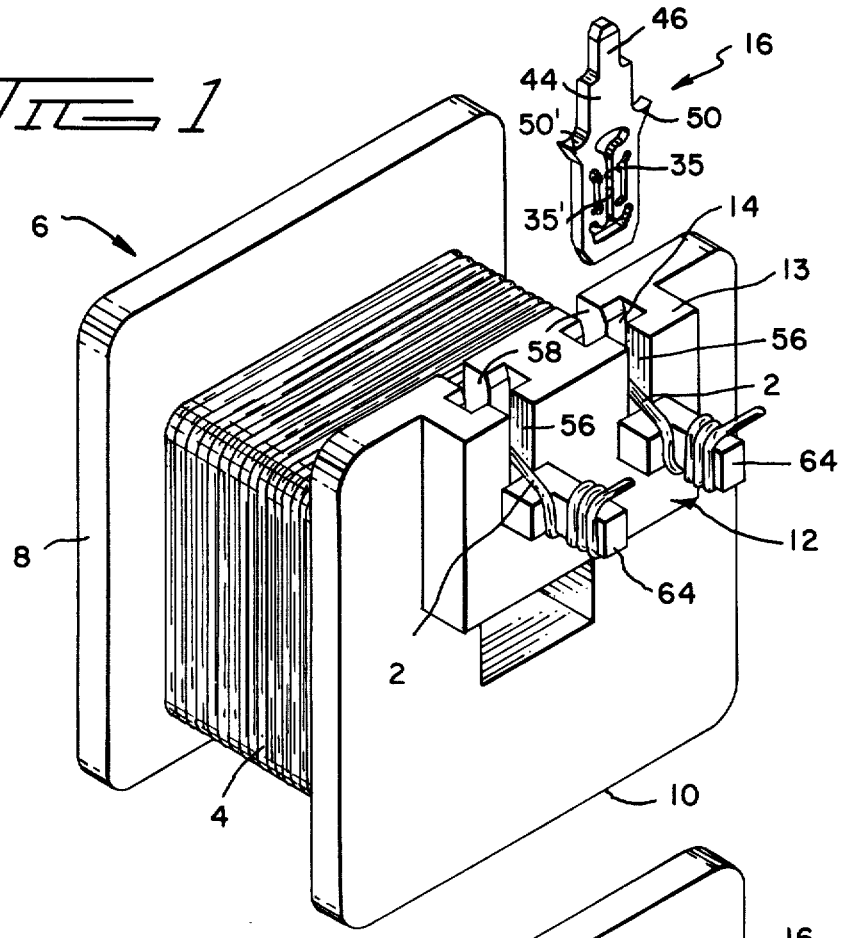
FIG. 1 is a perspective view of a typical coil bobbin having a terminal housing integral with one of its flanges and showing terminals exploded from the terminal-receiving cavities of the housing.
Figure 2:
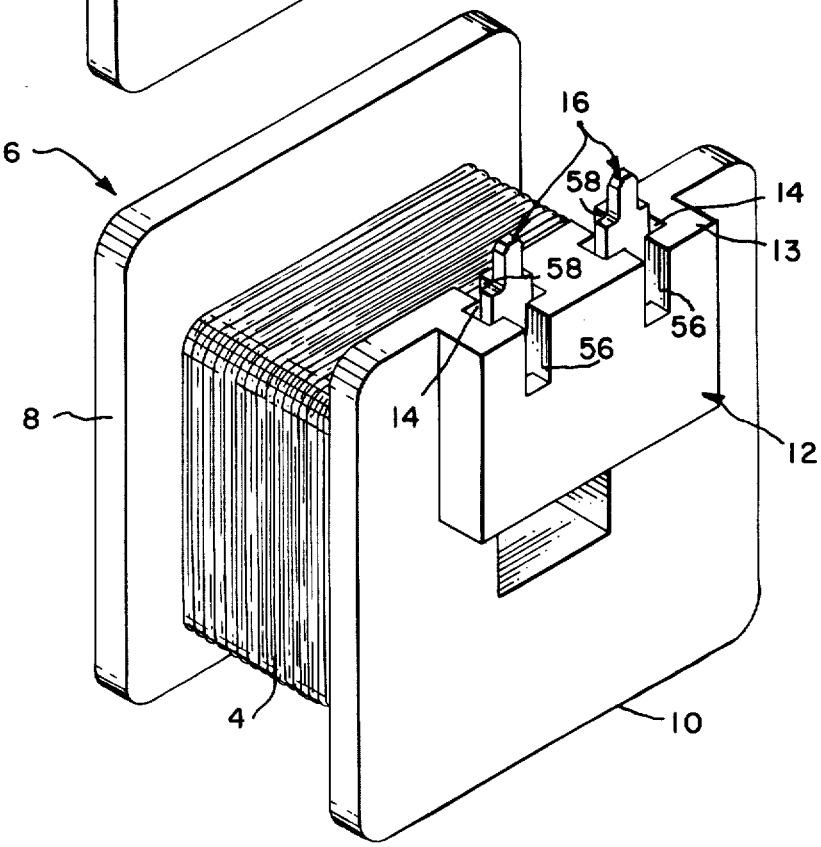
FIG. 2 is a perspective view of a bobbin showing the terminals inserted into the cavities and in electrical contact with the ends of the coil wire.

Referring first to FIGS. 1 and 2, the disclosed embodiment of the invention serves to establish electrical contact with the ends 2 of a coil 4 on a bobbin 6. The bobbin has spaced-apart flanges 8, 10 and a housing 12 is provided integrally with the flange 10. The housing 12 has two terminal-receiving cavities 14, each of which is dimensioned to receive a terminal 16.

Each terminal 16 comprises a flat sheet metal member having a leading end 18, a trailing end 20, and two integral four-bar linkage mechanisms 21, 21' between the ends 18, 20. The terms "leading" and "trailing" are used to define the ends of a terminal with reference to the direction of movement of the terminal into a cavity.

Figure 3:
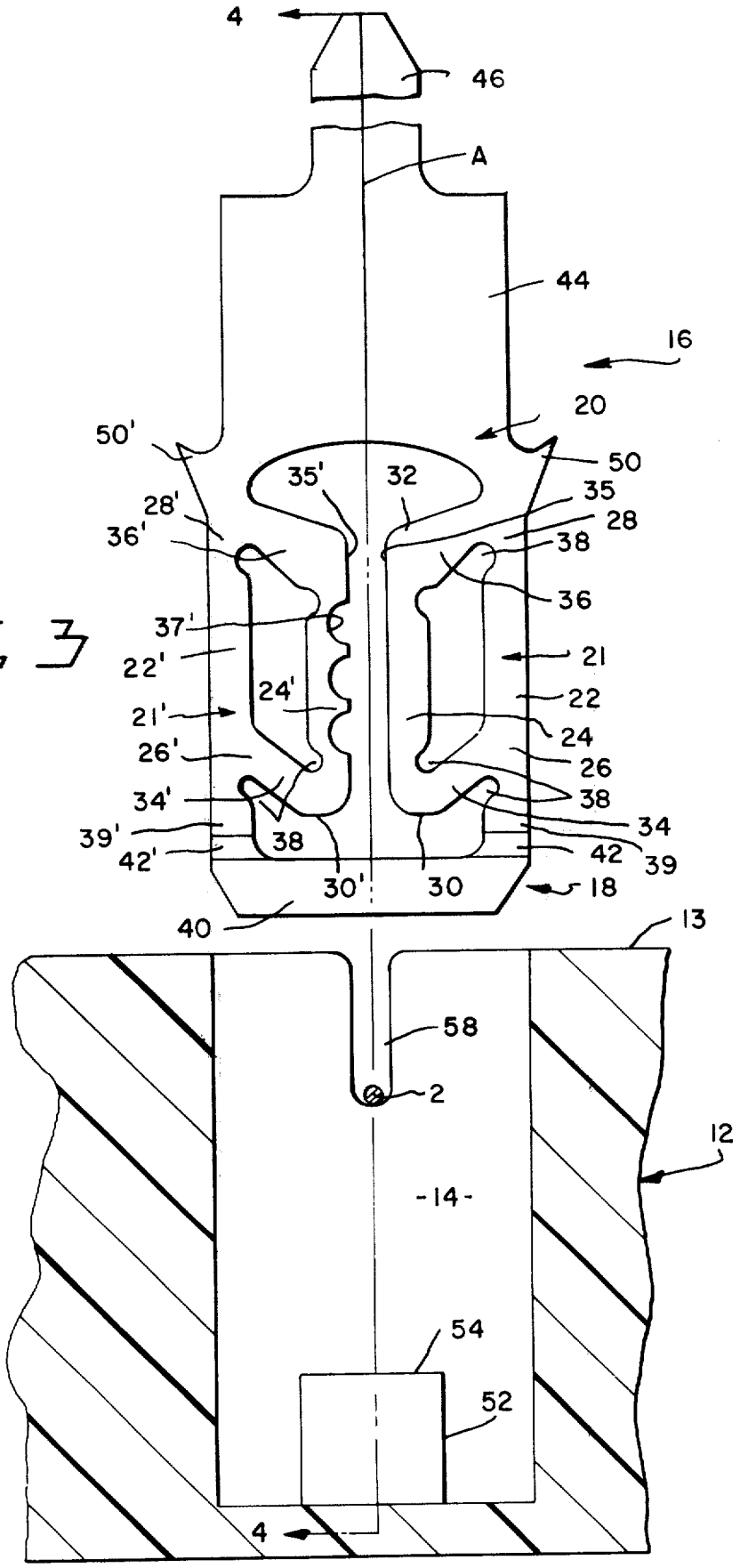
FIG. 3 is a fragmentary plan view showing a terminal and a terminal housing which is integral with one of the bobbin flanges, the terminal being exploded from the cavity of the housing.

The two four-bar mechanisms 2 are symmetrically located on each side of an axis of symmetry "A" shown in FIG. 3 which extends medially through the ends 18, 20. Since the two linkage mechanisms 21, 21' are substantially mirror images of each other, a description of one will suffice for both and the same reference numerals, differentiated by prime marks, will be applied to corresponding structural elements of the two mechanisms. The four-bar linkage on the right in FIG. 3 is accordingly described in detail below.

The linkage mechanism 21 comprises a fixed link 22 which extends parallel to, and is relatively remote from, the axis "A" and a connecting link or floating link 24 which is substantially parallel to the axis "A" and immediately adjacent to the axis. The fixed link 22 has a leading end 26 and a trailing end 28 and the connecting link 24 has a leading end 30 and a trailing end 32. The term "connecting link" is used with reference to the member 24 in conformity with the accepted terminology which is applied to four-bar mechanisms. First and second crank links 34, 36 extend from the leading and trailing ends 30, 32 of the connecting link 24 to the corresponding ends 26, 28 of the fixed link 22. These crank links extend diagonally away from the axis of symmetry "A" and away from the leading end 18 of the terminal.

As will be explained below, when the terminal 16 is inserted into the cavity 14 in the housing, the connecting links 24, 24' move relatively towards each other and into clamping engagement with the conductor 2, which is located between the opposed edge surfaces 35, 35' of the connecting links. It is desirable to provide conductor penetrating edges on at least one of the surfaces 35, 35' and in the disclosed embodiment, these edges are formed by providing as half-round recesses 37' in the edge surface 35' of the connecting link 24'.

As shown at 38, 38', radii are provided at several locations where the crank links merge with the connecting links and the fixed links. These radii 38, 38' facilitate and control deformation of the linkage mechanisms when the terminal is inserted into a cavity as will also be described below.

The terminal is of uniform thickness throughout its length except for the leading end 18 which comprises a transversely extending bar 40 of reduced thickness and which is connected to projecting portions 39, 39' of the fixed links 22, 22' by inclined ramp surface portions 42, 42'. The trailing end 20 merges with a generally regular flat web 44 at the upper end of the terminal and an integral tab 46 extends upward from the web as viewed in FIG. 3. This tab is dimensioned to be mated with a quick disconnect type terminal crimped onto a lead wire thereby to connect the ends of the coil to the lead wires. Barbs 50, 50' extend outwardly from the side edges of the terminal and serve to retain it in a cavity after insertion.

Terminals as shown in FIG. 3 can be produced by etching sheet metal stock or by stamping operations and in any event are advantageously produced as a continuous strip with adjacent terminals connected to each other by integral connecting sections 48. The reduced thickness bar 40 may be obtained by milling the metal stock before it is fed to the stamping die. These connecting sections can be sheared off at the time of insertion of the leading terminal of the strip into a housing cavity, such insertion being preferably accomplished with an automatic or semi-automatic insertion machine.

Figure 4:
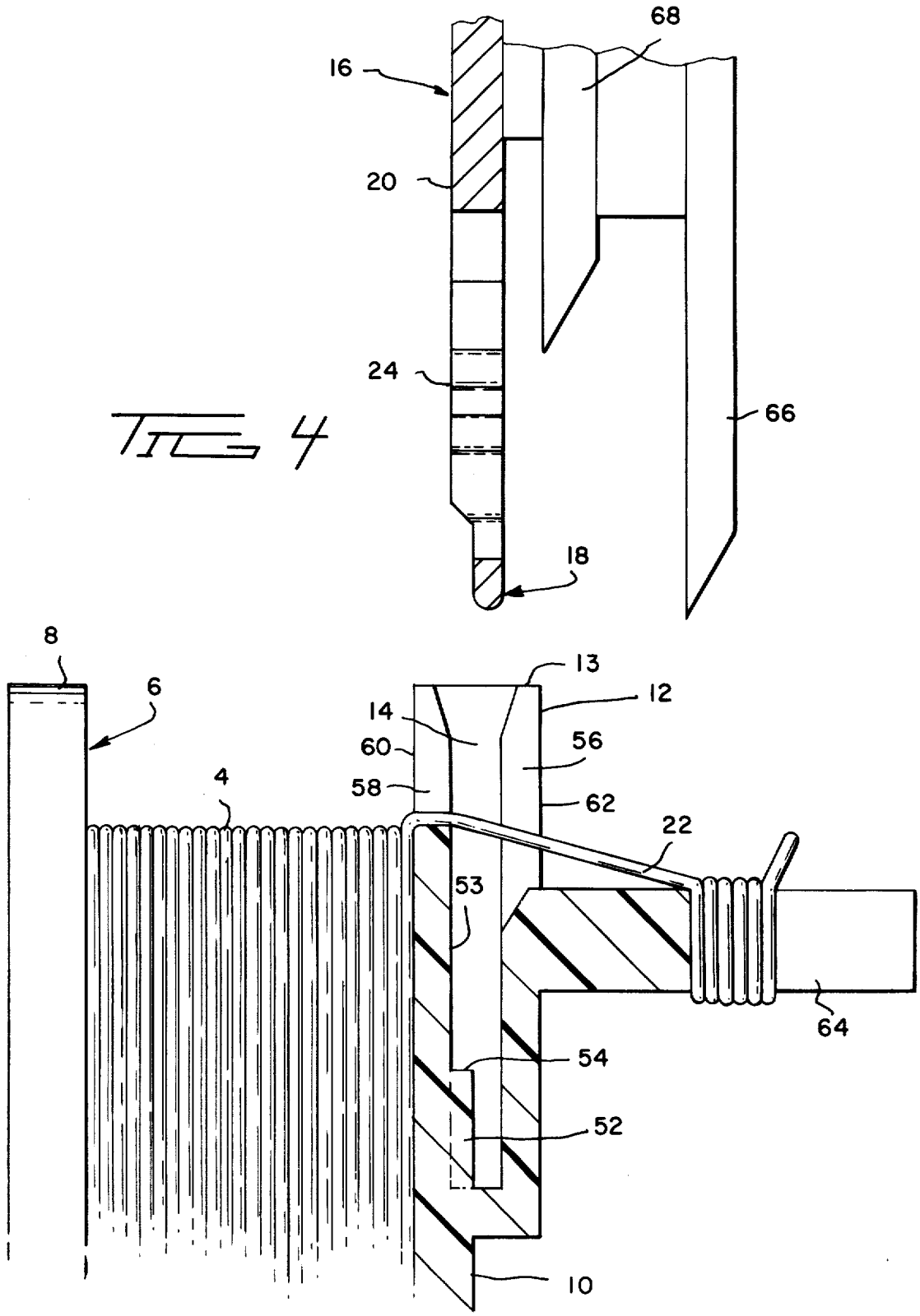
FIG. 4 is a cross-sectional view taken along the line 4—4 of FIG. 3 and showing the lower portion of a cutting tool which trims the end of the wire before insertion of a terminal and which severs a binding post from the housing.

As shown in FIGS. 3 and 4, the cavity 14 is a simple rectangular chamber which extends inwardly from the terminal-receiving surface 13 of the housing and is dimensioned to receive the terminal relatively snugly. A centrally located boss 52 is provided on one internal sidewall 53 of the cavity and this boss has an upwardly facing shoulder surface 54 as viewed in FIG. 4 which is engagable with the leading ends 30, 30' of the contacting links 24, 24' during insertion of the terminal. A wire-admitting slot 58 is provided in the housing in the external housing sidewall 60 which is proximate to the coil 4 on the bobbin and an additional wire-admitting slot 56 is provided in the outwardly facing external housing sidewall 62. The sidewall 62 has an integral binding post 64 extending therefrom adjacent to the lower end of the slot 56 and the end of the wire is secured by wrapping it around this binding post, an operation which can be accomplished by the coil winding machine.

Figures 5, 6, 7, 8:
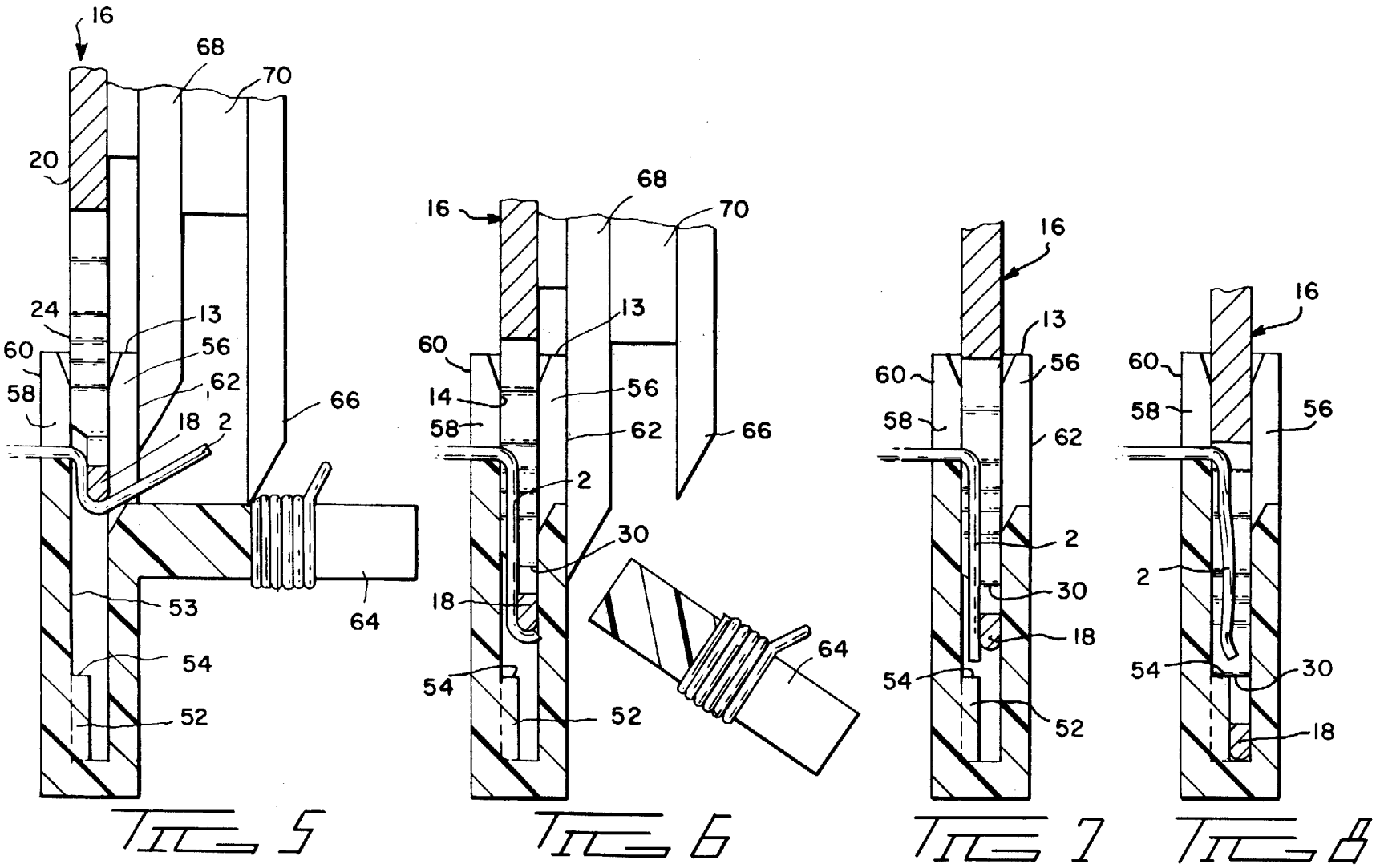
FIGS. 5–8 are viewed similarly to FIG. 4, showing successive stages of movement of the terminal into the cavity of the housing.
Figure 9:
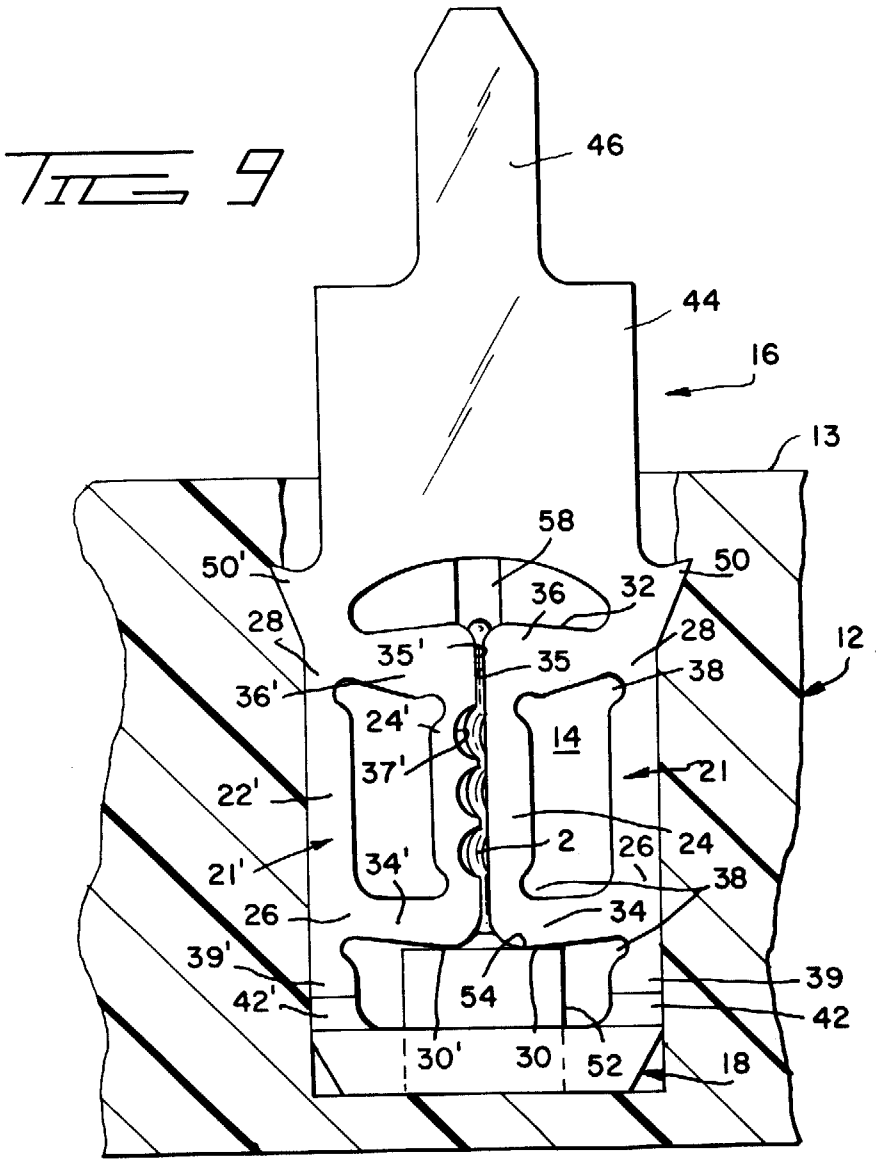
FIG. 9 is a view similar to FIG. 3, but showing the terminal in its inserted position with the four-bar linkages in their deformed or deflected conditions.

The ends 2 of the coil wire are connected to terminals as shown in FIGS. 4–8 by simply inserting a terminal into each of the cavities 14 with the terminals oriented such that their reduced thickness lower end portions 40 are on the right, as viewed in FIG. 4. The ends of the wires are cut prior to engagement of the terminals with the wire by means of a first cutting blade 66 which moves against the wire in advance of the terminal, so that the wire end is free to move when it is engaged by the terminal as shown in FIG. 5. As also shown in FIGS. 4–8, when the wire is wrapped around the binding post 64, it slopes from the wire-admitting slot downwardly and the portion of wire which extends from the slot 58 to the post 64 is, after being cut by the blade 66, repositioned in the cavity 14 until it is disposed between the opposed surfaces 35, 35' of the connecting links 24, 24'. When the leading ends of the connecting links move against the shoulder surface 54, the two four-bar linkages are deformed until the crank links extend substantially normally of the fixed links and the connecting links as shown in FIG. 9. During such deformation of the linkage mechanisms, the connecting links move towards each other and clamp the wire between their opposed surfaces. The edges provided by the half-round recess 37' penetrate the wire and ensure good electrical contact.

While the opposed edge surfaces 35, 35' are described above as being substantially parallel to the axis "A", it is desirable to have a very slight taper or inclination on these parts such that they are inclined towards the axis from their upper ends 32, 32' to the lower ends 30, 30' of the floating links. This inclination should be very slight and would not be apparent from the drawing. The provision of this slight inclination would ensure that upon deformation of the four-bar linkages, a portion of the wire would be pinched or clamped initially adjacent to the lower ends of the edges 35, 35' and in the fully deformed condition of the linkages, the degree to which the wire would be pinched or clamped would decrease towards the upper ends of these edge surfaces. This arrangement would ensure intimate contact with the wire at some location and decreasing clamping force above the location of the maximum clamping force.

The precise configuration of an optimum terminal in accordance with the invention may vary somewhat from the configuration shown in the drawing depending upon such variables as the size of the terminal, the thickness of the terminal stock from which it is stamped, and the temper of the metal stock. For example, the links 36, 34 and 36', 34' are relatively thick as shown in order to prevent collapse of these links, or twisting of these links when the four-bar linkages are deformed. The precise dimensions of these links will depend upon the variables discussed above.

The terminals are advantageously inserted by means of an insertion apparatus having a ram for driving the terminals into the cavity. The cutter 66 can be mounted on this ram along with an additional cutter 68 which serves to sever the binding post 64 from the surface 62 of the housing since this post is not useful after the terminals are inserted into the cavities. The two cutters 66, 68 are held in proper spaced relationship to each other on the insertion ram by a suitable spacer 70.

Figure 10:
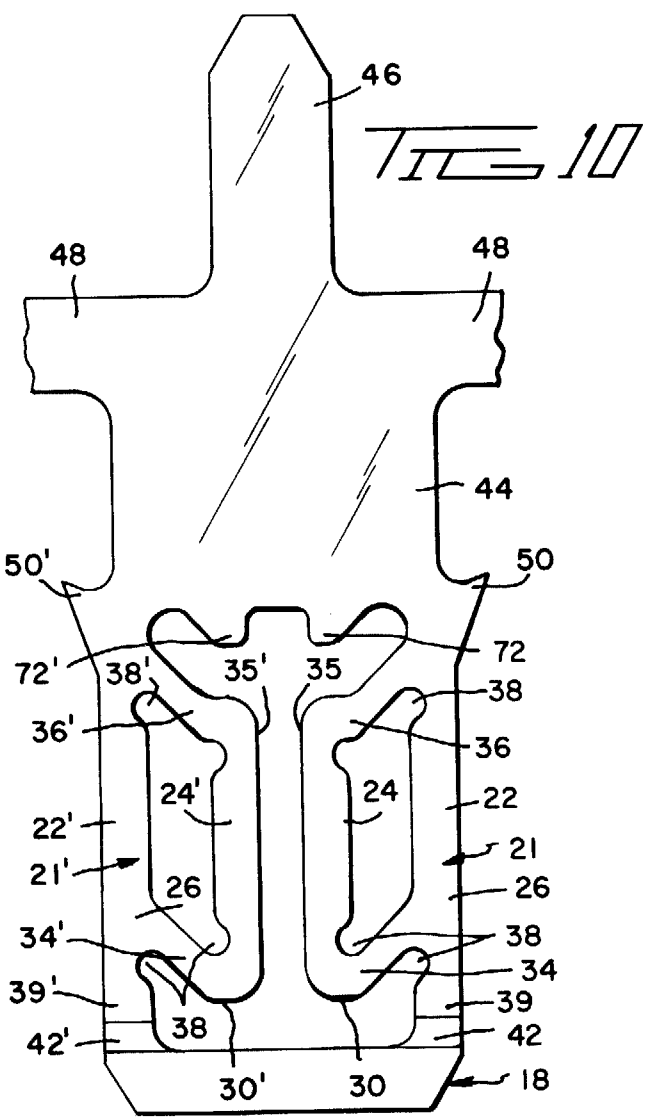
FIG. 10 is a frontal view of a terminal in accordance with an alternative embodiment of the invention.

FIG. 10 shows an alternative embodiment having stops 72, 72' on the trailing end 20 of the terminal which engages the trailing ends 32, 32' of the connecting links 24, 24' when the crank links 34, 36 and 34', 36' are moved to their final position. These stops may be used to ensure that the linkage mechanisms will not be moved off center with the resulting loosening of the grip of the connecting links on the wire.

As mentioned previously, connecting means in accordance with the invention can be designed for a wide range of wire gauges and the advantages of the invention are particularly attractive when connections must be made to wires in the range of AWG-30 to AWG-50. An AWG-30 wire having a thin varnish type insulating coating thereon has a diameter of about 0.010 inches including the insulating coating and an AWG-46 wire has a diameter of about 0.0018 inches, including the insulating coating. It can readily be appreciated that wires in the lower end of this range are extremely weak and will not withstand high tensile forces when the connections to them are made. In accordance with the principles of the present invention, the wires are not significantly stressed at any time during the terminating process but are merely repositioned between the opposed surfaces of the connecting links and then clamped or held in compression between the opposed surfaces of these links. No substantial tensile forces are applied to the wire and, in fact, since the connecting links move relatively upwardly as viewed in the drawing, while they are moving toward each other, a very small loop is formed in the wire between the wire-admitting slot 58 and the terminal.

Connecting means in accordance with the invention can be of relatively small size and therefore can be of a size which is consistent with the size of a coil of AWG-30 to AWG-50 wire. One terminal in accordance with the invention, properly scaled to wires in this size range has an overall height between the lower end 40 and the upper end of the tab 46 of 0.350 inches and an overall width of 0.116 inches. The terminal can be produced of relatively thin material stock such as brass, having a thickness of 0.012 inches to 0.016 inches. The material used for the manufacture of the terminal should not be extremely hard and should not be resistant to deformation in order to permit deflection of the four-bar mechanisms. For example, brass having a two-hard temper designation is to be preferred to the harder grades commonly used for electrical terminals.

As is apparent from FIGS. 1 and 2, the housing on the bobbin flange 10 is also relatively small and does not project an undue amount beyond the surface of the flange.

We claim:

1. An electrical terminal which is applicable to a conductor to establish electrical contact with said conductor, said terminal comprising:

a one-piece sheet metal member having spaced-apart leading and trailing ends, first and second integral four-bar linkage mechanisms between said ends, each of said mechanisms comprising a connecting link, first and second crank links, and a fixed link, said linkage mechanisms being located in a common plane and being substantially symmetrical with respect to an axis extending between said first and second ends, said connecting links being adjacent to, and extending substantially parallel to, said axis, said connecting links being spaced from each other, said fixed links being spaced from, and extending parallel to, said axis, each of said connecting links and fixed links having a leading end which is adjacent to said leading end of said terminal and a trailing end which is adjacent to said trailing end of said terminal, each of said first crank links of each mechanism extending from the leading end of the associated connecting link to the leading end of the associated fixed link, and each of said second crank links extending from the trailing end of the associated connecting link to the trailing end of the associated fixed link, all of said crank links extending diagonally away from said leading end and away from said axis, each of said connecting links and said crank links being movable relatively towards said trailing end of said terminal with concomitant movement of said connecting links laterally towards each other upon application of a deforming force to said leading ends of said connecting links in a direction parallel to said axis, said terminal being flat and having been produced by removing material from flat sheet metal stock without bending, said terminal being of reduced thickness at said leading end to permit application of said deforming force to said leading ends, of said connecting links whereby, upon placing said conductor between said connecting links and application of said deforming force to said connecting links, said connecting links will move against, and into clamping engagement with, said conductor and establish electrical contact with said conductor.

2. An electrical terminal as set forth in claim 1, said connecting links having opposed surfaces which move against said conductor when said deforming force is applied, said opposed surfaces having penetrating means thereon for penetrating said conductor.

3. An electrical terminal as set forth in claim 2, said terminal having integral contact means extending therefrom for contact with a complementary terminal.

4. A terminal as set forth in claim 3, said integral contact means comprising a contact tab extending from said trailing end.

5. An electrical terminal as set forth in claim 2, said penetrating means comprising edges on said surfaces.

6. An electrical terminal applied to, and in electrical contact with, a conductor, said terminal comprising a flat one-piece member having a leading end, a trailing end, and spaced-apart parallel fixed links extending between said ends, a pair of contact members between said ends and between said fixed links, said contact members extending parallel to said fixed links, said conductor being clamped between said contact members, at least one of said contact members being connected to its associated fixed link by spaced-apart crank links which extend substantially normally from said associated fixed link, said one contact member, said crank links, and said fixed link being a deformed four-bar linkage mechanism, said one contact member being the connecting link and said fixed link being the fixed link of said mechanism, said crank links being stressed in compression and serving to hold said one contact member against said conductor.

7. Electrical connecting means for establishing an electrical connection to a conductor comprising:

a terminal member and a housing, said housing having a cavity therein which is dimensioned to receive said terminal, said terminal comprising a one-piece sheet metal member having spaced-apart leading and trailing ends and having spaced-apart fixed link members extending between said ends, spaced-apart contact members between said ends and between said fixed link members, at least one of said contact members extending parallel to said fixed link members and being one element of a mechanism, said mechanism comprising, in addition to said one contact member, one of said fixed link members and additional link means extending between said one contact member and said one fixed link member, said mechanism being kinematically deformable upon application of a deforming force to the end of said one contact member which is adjacent to said leading end of said terminal, said one contact member being movable laterally towards the other contact member upon deformation of said mechanism, said housing having a terminal-receiving surface, said cavity extending into said housing from said terminal-receiving surface, wire-admitting slot means in said housing communicating with said cavity and extending inwardly from said terminal-receiving surface, said cavity having an inner end having shoulder means thereon adjacent to, but spaced from said inner end, said shoulder means being engageable with said one end of said one contact member during movement of said terminal into said cavity whereby, upon placement of said conductor in said wire-admitting slot means with portions of said conductor extending across said cavity and upon insertion of said terminal, leading end first, into said cavity, said leading end of said terminal engages said conductor, pulls portions of said conductor toward said inner end of said cavity thereby to position said portions of said conductor between said contact members, and upon engagement of said one end of said one contact member with said shoulder means, said mechanism is deformed and said one contact member is moved laterally towards said other contact member and said conductor is clamped between said contact members.

8. Electrical connecting means as set forth in claim 7, said mechanism comprising a four-bar linkage, said one fixed link constituting the fixed link of said linkage, and said one contact member constituting the connecting link of said linkage, said mechanism having two parallel crank links extending between said fixed link and said connecting link.

9. Connecting means as set forth in claim 8, said terminal having a second four-bar linkage, the other one of said contact members being the connecting link of said second four-bar linkage, said contact members being movable towards each other upon deformation of said four-bar linkages.

10. Connecting means as set forth in claim 7, said housing being integral with a coil bobbin.

* * * * *